United States Patent [19]

Saur et al.

[11] Patent Number: 4,955,431

[45] Date of Patent: Sep. 11, 1990

[54] COOLING DEVICE FOR AN INTERNAL COMBUSTION ENGINE AND METHOD FOR CONTROLLING SUCH A COOLING DEVICE

[75] Inventors: Roland Saur, Stuttgart; Rolf Schaper, Ditzingen, both of Fed. Rep. of Germany

[73] Assignee: Behr-Thomson Dehnstoffregler GmbH, Kornwestheim, Fed. Rep. of Germany

[21] Appl. No.: 155,118

[22] Filed: Feb. 11, 1988

[30] Foreign Application Priority Data

Apr. 4, 1987 [DE] Fed. Rep. of Germany ..... 3711392

[51] Int. Cl.[5] ..... F01P 7/04; G05D 23/02; G05D 23/24

[52] U.S. Cl. ..... 165/1; 165/39; 165/40; 123/41.12; 123/41.44; 123/41.49; 236/35; 236/76; 236/99 E; 388/822; 388/908; 388/934

[58] Field of Search ..... 123/41.12, 41.49, 41.44; 318/334; 236/35, 76, 99 E; 62/184, 228.4; 165/1, 39, 40

[56] References Cited

U.S. PATENT DOCUMENTS

| | | | |
|---|---|---|---|
| 1,900,586 | 3/1933 | Rippe | 236/35 |
| 1,912,154 | 5/1933 | Morrison | 236/35 |
| 2,081,879 | 2/1982 | Ohashi | 165/25 |
| 3,777,234 | 12/1973 | Luger | 318/334 |
| 4,083,332 | 4/1978 | Neveux | 123/41.12 |
| 4,313,402 | 2/1982 | Lehnhoff et al. | 123/41.12 |
| 4,691,668 | 9/1987 | West | 123/41.14 |
| 4,712,030 | 12/1987 | Lakin et al. | 165/80.3 |

FOREIGN PATENT DOCUMENTS

| | | | |
|---|---|---|---|
| 0054476 | 6/1982 | European Pat. Off. . | |
| 2806708 | 8/1978 | Fed. Rep. of Germany | 123/41.12 |
| 0110807 | 7/1983 | Japan | 123/41.12 |
| 0211523 | 12/1983 | Japan | 123/41.12 |
| 0085422 | 5/1984 | Japan | 123/41.12 |
| 0081422 | 5/1985 | Japan | 123/41.12 |
| 0295896 | 12/1986 | Japan | 318/334 |

OTHER PUBLICATIONS

"Linear Amplifiers—Operation and Application of Operational Amplifiers and Other Linear Circuits" by Dr. Ing. Gerd Harms, 1978.

*Primary Examiner*—John Ford

*Attorney, Agent, or Firm*—Foley & Lardner, Schwartz, Jeffery, Schwaab, Mack, Blumenthal & Evans

[57] ABSTRACT

A device and method for cooling an internal combustion engine is disclosed in which a simple control circuit constructed of relatively inexpensive components enables the rotational speed of an electric motor employed in the cooling device to be controlled in adaptation to various temperature levels of a cooling circuit. The control circuit includes a power semiconductor which is used to drive the electric motor in certain speed ranges associated with predetermined temperature levels. The control circuit also incorporates a bypass circuit that permits the electrical motor to be driven in particular speed ranges without the use of the power semiconductor. Thus, the electric motor can be driven at one hundred percent of its speed capacity by eliminating a voltage drop associated with the power semiconductor.

18 Claims, 4 Drawing Sheets

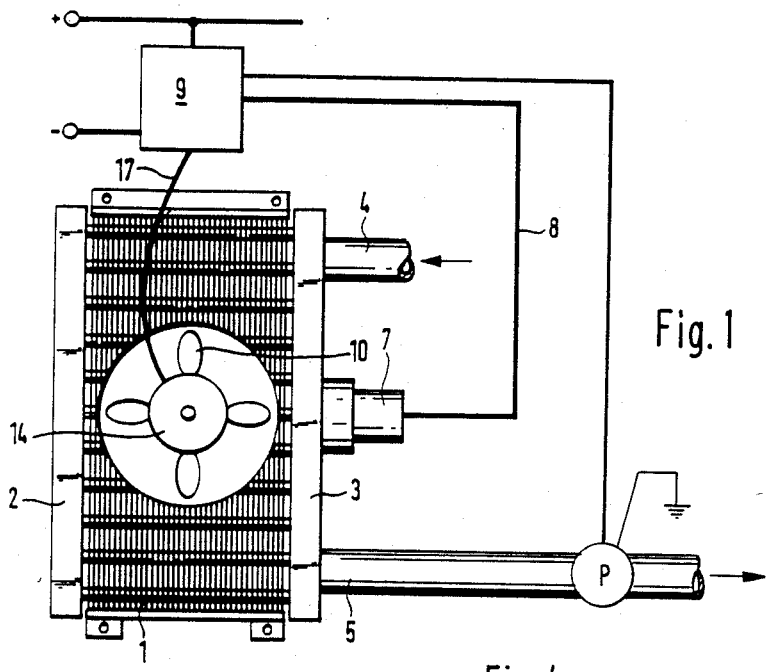
Fig. 1
Fig. 4
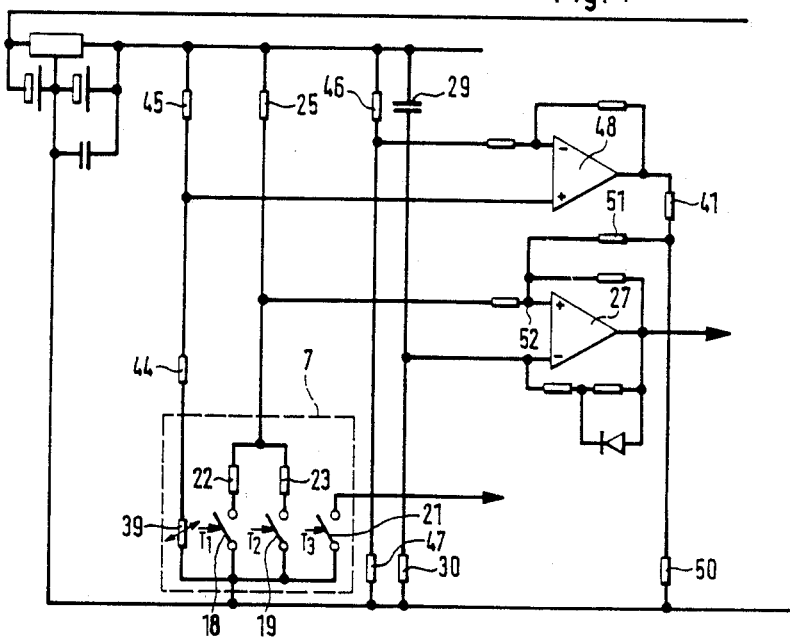

COOLING DEVICE FOR AN INTERNAL COMBUSTION ENGINE AND METHOD FOR CONTROLLING SUCH A COOLING DEVICE

BACKGROUND OF THE INVENTION

The invention relates to a cooling device for an internal combustion engine, particularly a motor vehicle. A device for controlling the temperature of a cooling system of an internal combustion engine, particularly for motor vehicles, is known from German Patent Specification No. 2,806,708. This device comprises a circuit, which connects the engine to a heat exchanger, for a coolant which is circulated by means of a cooling water pump of the engine. Furthermore, it comprises a blower system having at least two blower units for the heat exchanger, which can be operated in at least two capacity ranges which are independent of the rotational speed of the engine. In addition, this device comprises several temperature switches which are arranged at different measuring points and which are associated with particular temperature thresholds. The blower motors are driven at a medium speed when a first temperature threshold is exceeded and at the maximum speed when a second temperature threshold is exceeded.

However, such a device has the disadvantage that two complete blowers (fan and engine) are required and that the blowers can only be operated at two different rotational speeds. The different temperature ranges occurring in a cooling system can only be inadequately taken into account in this manner. Furthermore, the maximum speed of the blowers becomes necessary in such devices so that the blower noise, which is felt to be disturbing at maximum speed, occurs relatively frequently.

A circuit for an electric drive motor of a fan for a radiator of a motor vehicle internal combustion engine is known from European Preliminary Published Specification No. 0,054,476, the electric motor being driven in dependence on the respective temperature of the cooling water. In this arrangement, the rotational speed of the electric motor can be influenced by means of a power semiconductor which is driven in dependence on the signal of a temperature sensor via an electronic circuit. Furthermore, a relay is provided, the switching contact of which is connected in parallel with the power semiconductor and bypasses the power semiconductor in particular operational conditions. The relay is a component of a safety circuit which is designed in such a manner that the relay is activated when the drive to the power transistor corresponds to a turn-on period of 100%. In addition, the relay is connected when the temperature sensor fails. Although the known circuit has the advantage that continuous control of the rotational speed of the electric motor or of the fan is possible, an elaborate drive system or the use of semiconductors which have very high capacity and are thus expensive is necessary.

It is not good practice to operate the power transistor with a relative operating time of more than 95% since the pulse current load capacity, particularly of metal oxide power transistors, is three to four times as high as in constantly conducting operation. In addition, a particular voltage is invariably dropped across the power transistor because of the resistance between the drain and source terminals, so that with a relative operating time of 100% of the power transistor only a rotational speed is achieved which is noticeably below the rated speed.

SUMMARY OF THE INVENTION

The present invention therefore has the object of creating a cooling device for an internal combustion engine in which a simple control circuit constructed of relatively inexpensive components enables the rotational speed of the electric motor to be controlled in adaptation to various temperature levels of the cooling circuit and in which the operation of the drive motor via the power semiconductor is prevented in particular unfavorable speed ranges. In addition, it is the object to develop a method for controlling such a cooling device.

The essential advantages of the invention are to be seen in the fact that only a small circuit expenditure is needed for controlling the rotational speed of the motor and the electric motor, nevertheless, can be operated at a number of different rotational speeds.

According to the invention, the object of developing a method for controlling such a cooling device is achieved by the fact that switching contacts are successively closed by means of the temperature-sensitive sensor when predetermined switching thresholds are reached, as a result of which the input parameter at a non-inverting input of an operational amplifier and its output level is changed and, as a result of the changed output level of the operational amplifier, the power semiconductor is driven in such a manner that the electric motor is operated at particular rotational speeds associated in steps with the respective switching thresholds, and the power semiconductor is bypassed when the last switching contact closes.

An advantageous development of the subjectmatter of the invention consists in the electronic components influencing the input parameters being ohmic resistances. In this manner, the circuit arrangement can be adapted in a simple manner to any arbitrary cooling device since, for determining the pulsing frequency and thus also the speed steps, only the ohmic resistances associated with the switching contacts must be appropriately designed.

For the purpose of component integration, it is proposed that the switching contacts are jointly arranged in a step switch. An element of extensible material interacting with the step switch is in a preferred manner suitable as temperature sensor. In such a case, the step switch is suitably arranged at the radiator tank of the heat exchanger, and the element of extensible material projects into the radiator tank so that the cooling water stream flows round it.

The power semiconductor is preferably an N-channel metal oxide field effect transistor and the operational amplifier a voltage-controlled frequency generator. To apply a suitable control voltage to the gate of the metal oxide field effect transistor, a switching transistor, the base of which is connected to the output of the frequency generator via two inverting switching stages, is connected between a positive pole of the voltage source and the gate of the metal oxide field effect transistor.

Since the turn-on currents of high-power electric motors are large, a speed control which is to begin at very low rotational speeds can only be handled by connecting high-capacity semiconductors in parallel. When a particular rotational speed is reached, the current consumption drops, due to the effect of the counter EMF, into a range in which lower-power semiconductors can be used. For this reason, an advantageous development of the subject matter of the invention consists of the fact that a switching contact is provided which opens in dependence on the rotational speed of the electric motor and which follows the first-closing switching contact and bypasses the power semiconductor until a first speed step is reached. This ensures that the electric motor does not need to be started via the power semiconductor and the high turn-on currents occurring during this process are kept away from the power semiconductor so that the latter is only operated in an operating range in which the load does not assume any extreme values. In addition, the full voltage is available to the electric motor for starting so that a high rotational torque is achieved.

Another further development of the subject matter of the invention consists in the fact that a normally open contact of a relay with a resistor are provided in a line branch connected in parallel with the switching contacts with the resistors, and the relay coil is driven by a signal which is dependent or a particular rotational speed of the internal combustion engine or a voltage of the dynamo. This embodiment is appropriate in particular when the electric motor drives the water pump. This ensures that the water pump is not operated when the internal combustion engine is at a standstill, and thus the total energy is available for the starting process and that, in addition, a minimum rotational speed of the water pump is ensured during operation of the internal combustion engine.

If the electric motor, or the blower driven by it, is intended to have a control characteristic by means of which a steady proportional increase in rotational speed occurs within a particular range of the cooling water temperatures and the increase in rotational speed is to occur in steps outside this temperature range, it is proposed that a temperature sensor in the form of a thermistor is provided which is connected via a voltage divider to the noninverting input of a second operational amplifier and the output of this amplifier is connected to the noninverting input of the first operational amplifier.

To keep the necessary connecting lines as short as possible, it is of advantage to combine the control electronics, at least insofar as they include the power semiconductor and the operational amplifier, into one constructional unit and to arrange this constructional unit directly at the electric motor on its side facing away from the fan wheel. As a result, the constructional unit is located at a place which is less soiled and does not generate any additional flow resistance for the fan air flow.

BRIEF DESCRIPTION OF THE DRAWINGS

In the text which follows, illustrative embodiments of the -cooling device according to the invention are explained in greater detail with reference to the drawings, in which:

FIG. 1 shows a diagrammatic representation of a cooling device,

FIG. 4 shows a variant of an embodiment of the temperature-dependent switching contacts in combination with a parallel-connected temperature sensor.

DETAILED DESCRIPTION OF THE PREFERRED EMBODIMENTS

Figure 3:
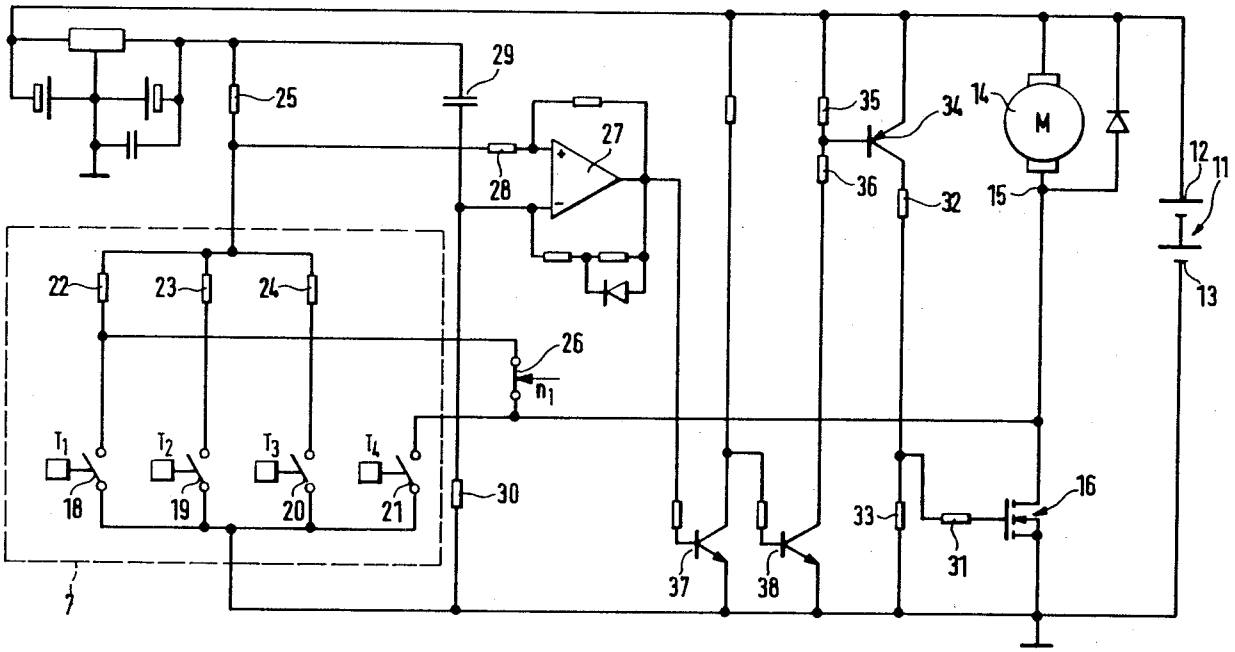
FIG. 3 shows a circuit diagram of an electric control circuit for a radiator fan of a motor vehicle.
Figure 6:
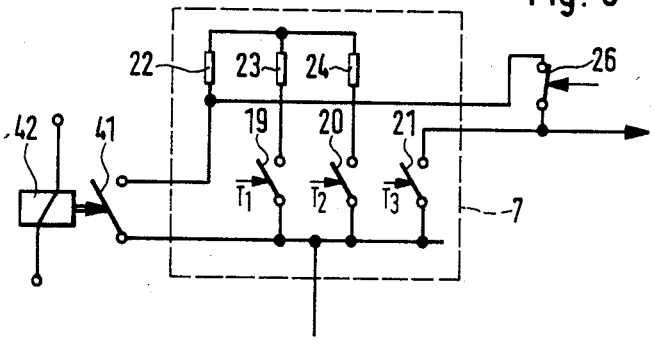
FIG. 6 shows a variant of an embodiment of the temperature-dependent switching contacts which, in particular, is suitable for operating a water pump.

FIG. 1 diagrammatically represents a cooling device which essentially comprises a heat exchanger 1 with lateral radiator tanks 2 and 3 and a radiator fan 10 which is driven by an electric motor 14. A cooling water inlet 4 and a cooling water return 5 are provided at the radiator tank 3. In addition, a switching unit 7, which will still be explained in greater detail in the text which follows with reference to FIGS. 3, 4 and 6, is also arranged at the radiator tank 3. The switching unit 7 which is operated by a temperature-controlled working element, for example an element of extensible material, is connected via a connecting cable 8 to an electronic unit 9. A connecting cable 17 leads from the electronic unit 9 to the electric motor 14 which drives the fan 10.

Figure 2:
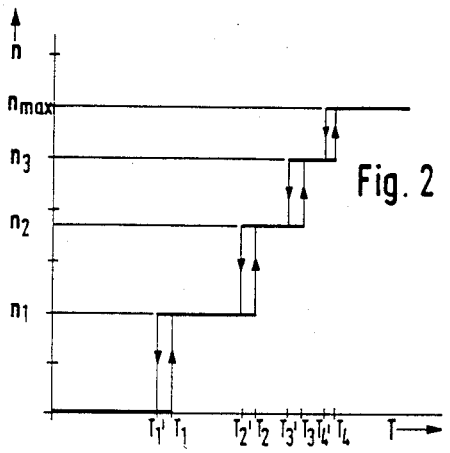
FIG. 2 shows a control characteristic.

In the representation according to FIG. 2 the rotational speed n of the fan motor is plotted against the temperature T of the cooling water. In this control characteristic, the fan motor is at a standstill until a temperature value $T_1$ is reached. When a first temperature threshold is reached at $T_1$, the fan motor is connected and brought to a rotational speed $n_1$.

As the temperature rises, the motor speed $n_1$ is maintained until a second temperature threshold is reached at $T_2$. When this second temperature threshold $T_2$ is reached, the fan motor is brought to a second speed step $n_2$ and maintains this rotational speed until the next temperature threshold is reached at $T_3$. When this temperature is reached, the fan motor is operated at the rotational speed $n_3$. The next switching threshold is reached at a temperature of $T_4$ at which the fan speed is raised from $n_3$ to $n_{max}$. When the temperature of the cooling water drops, that is to say also with a temperature drop before the last temperature threshold is reached at $T_4$, the rotational speed is dropped in steps $n_3$, $n_2$ and $n_1$ in accordance with the control characteristic, the respective dropping occurring at temperature thresholds $T_4'$, $T_3'$, $T_2'$, and $T_1'$ because of the hysteresis normally associated with the switching elements.

In FIG. 3, a battery of a motor vehicle, the positive pole 12 and the negative pole 13 of which are connected to the electric motor 14 is shown as voltage source 11. A metal oxide field effect transistor 16, called MOSFET in the text which follows, is connected into the connecting line between the negative terminal of the motor 14 and the negative pole 13 of the voltage source The control circuit also comprises a switching unit 7 which consists of a step switch having four switching contacts 18, 19, 20 and 21. The step switch is constructed in such a manner that the switching contacts 18, 19, 20 and 21 are successively closed, each time when predetermined temperature values $T_1$, $T_2$, $T_3$, $T_4$ are reached.

The switching unit 7 comprises three resistors 22, 23 and 24, one resistor in each case being allocated to the respective switching contacts 18, 19 and 20 in parallel line branches. The ends of the resistors 22, 23 and 24 remote from the switching contacts 18, 19 and 20 are short circuited by means of a link and, together with a resistor 25, form a voltage divider which is located between the positive and negative connections of a stabilized voltage.

A connecting line leads from the switching contact 21 to the negative terminal 15 of the electric motor 14. Furthermore, a speed-controlled normally closed contact 26 is provided which, on the one hand, is connected to the switching contact 18 and, on the other hand, to the negative terminal 15 of the electric motor 14. The normally closed contact 26 is opened when a predetermined speed step $n_1$ of the electric motor 14 is reached.

An operational amplifier 27 is connected with its non-inverting input via a resistor 28 to the voltage divider formed of the resistors 25 and 22, 23, 24. The inverting input is connected to an RC section formed from a capacitor 29 and an ohmic resistance 30.

The gate of the MOSFET 16 is connected via a resistor 31 to a voltage divider formed of resistors 32 and 33. A switching transistor 34, the base of which is connected to a voltage divider formed of resistors 35 and 36, is located between the resistor 32 and the positive pole 12 of the voltage source 11. The resistor 36 is connected to the output of the operational amplifier 27 via two inverting stages 37 and 38 in the form of NPN transistors.

In the text which follows, the operation of the radiator fan 10 in FIG. 1 is described with reference to the control characteristics shown in FIG. 2 and the circuit shown in FIG. 3. As long as the temperature of the cooling water is below a first temperature threshold, all switching contacts 18, 19, 20 and 21 are open so that the negative terminal 15 of the electric motor 14 is not connected to the negative potential of the voltage source. The electric motor 4 is thus at a standstill.

When a first temperature threshold $T_1$ is reached, the switching contact 18 is closed, as a result of which the negative terminal 15 of the electric motor 14 is connected to the negative potential of the voltage source 11 via the normally closed contact 26 and the switching contact 18. The result is that the electric motor 14 starts until it has reached a first speed step $n_1$. When the switching contact 18 closes, the input parameter is also changed via the resistor 22 at the non-inverting input of the operational amplifier 27, which generates at its output a pulse sequence, which is applied to the base of the switching transistor 34 via the two inverting stages 37 and 38. The gate of the MOSFET 16 is also driven in accordance with the pulse sequence, so that a relative operating time of the electric motor 14 is produced which corresponds to the first speed step $n_1$. Since the normally closed contact 26 is opened when the first speed step $n_1$ is reached, the electric motor 14 is thereafter supplied with the electric power exclusively via the MOSFET 16.

As the temperature rises further, the rotational speed of the electric motor 14 is maintained until a second temperature threshold $T_2$ of the cooling water is exceeded. This is when the contact 19 in the switching unit 7 is closed, which results in a reduction of the total resistance of the parallel circuit formed of resistors 22 and 23. As a result, the input parameter of the non-inverting input of the operational amplifier 27 is changed due to which the pulse sequence at the output of the operational amplifier 27 is influenced in such a manner that a longer relative operating time of the MOSFET 16 is produced. Due to the longer relative operating time, the electric motor 14 or the radiator fan 10 driven by it, respectively, is now operated at a second speed step $n_2$.

A further increase in the rotational speed of the electric motor 14 occurs only when a third temperature threshold $T_3$ is exceeded, at which point the switching contact 20 in the switching unit 7 is closed. When a top temperature threshold $T_4$ is exceeded, the switching contact 21 is closed by means of which the MOSFET 16 is bypassed. Bypassing the MOSFET 16 removes its load, which has the advantage that it is not exposed to any peak loading and the electric motor 14 reaches its maximum rotational speed, which could not be achieved even if the MOSFET 16 were to be driven at a relative operating time of 100%.

When the cooling water temperature drops, the switching contacts 18 to 21 in the switching unit 7 are opened again in-the reverse order, as a result of which the rotational speed of the radiator fan is lowered in steps.

FIG. 4 shows a variant of an embodiment of the temperature-dependent switching contacts and of the operational amplifier which could be used instead of the switching unit 7 and the subsequent amplifier unit in FIG. 3. The switching unit 7 exhibits three parallel connected switching contacts 18, 19 and 21, switching contact 18 being closed at a first predetermined temperature $T_1$ and the second switching contact 19 being closed at a second predetermined temperature $T_2$. The switching contacts 18 and 19 are followed by resistors 22 and 23. The switching contact 21 corresponds to the one described in FIG. 3 and has the same function of bypassing the MOSFET 16 when the highest temperature threshold $T_3$ is reached. Similar to FIG. 3, the resistors 22 and 23, together with a resistor 25, form a voltage divider to which is connected the non-inverting input of the operational amplifier 27. The connecting of the RC section to the inverting input also corresponds to FIG. 3.

The switching unit 7 in FIG. 4 also comprises a thermistor 39 which is in series with a voltage divider formed of ohmic resistances 44 and 45. A second operational amplifier 48 is connected with its non-inverting input to the voltage divider (resistors 44, 45) and with its inverting input to a second voltage divider formed of resistors 46 and 47. The output of the second operational amplifier 48 is connected to negative potential via a further voltage divider formed of resistors 49 and 50. The output of the second operational amplifier 48 is connected to a junction 52 at the non-inverting input of the operational amplifier 27 via a series resistor 51 connected to the voltage divider (resistors 49, 50).

Figure 5:
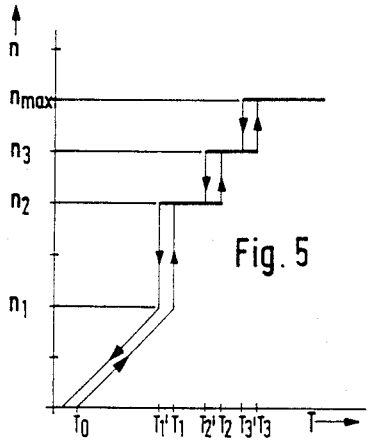
FIG. 5 shows a control characteristic which is achieved by means of the embodiment according to FIG. 4.

FIG. 5 shows a control characteristic which is achieved by means of the embodiment of the circuit according to FIG. 4 and an electronic control circuit which otherwise corresponds to FIG. 3. As can be seen from FIG. 5, an influence on the variable resistor 39 can be noted even at a relatively low temperature $T_0$ as a result of which the input parameter at the non-inverting input of the second operational amplifier 48 is influenced. At the output of the second operational amplifier 48, a signal is thus generated which is conducted via the resistors 49 and 51 to the junction 52, and thus is added to the voltage at the non-inverting input of the operational amplifier 27. The gain factor and thus the slope of the characteristic can be influenced in conventional manner by means of the dimensioning of the input and feedback resistors. The gate of the MOSFET 16 is driven in accordance with the output signal at the operational amplifier 27 and the electric motor 14 begins to rotate. As the temperature in the cooling water rises, the fan speed is steadily raised, because the relative operating time of the MOSFET 1 6 is correspondingly increased.

When the previously mentioned temperature threshold $T_1$ is reached, the switching contact 18 then closes as a result of which the input voltage at the operational amplifier 27 is considerably changed. The voltage applied to the junction 52 from the voltage divider of- the resistors 22 and 25 now dominantly influences the operational amplifier 27; the voltage component supplied from the output of the second operational amplifier 48 via the resistors 49 and 51 thus becomes insignificant. The consequence is that the rotational speed of the electric motor 14 is raised from a first speed step $n_1$, which was reached before the closing of the contact 18, to a second speed step of $n_2$. The same process is repeated when higher temperature thresholds are reached at $T_2$ and $T_3$ as is shown in FIG. 5.

FIG. 6 shows a variant of the embodiment of the switching unit 7 in FIG. 3 and can be used, for example, in the control circuit shown in FIG. 3. The reference symbols from FIG. 3 were used for the components which are essentially identical. In the representation of FIG. 6, a relay 42 is provided which switches a relay contact 41. The relay contact 41 is connected in parallel with the switching contacts 19 and 20, which are controlled in dependence on temperature, and it is followed by resistor 22 which is in parallel with the resistors 23 and 24. As in FIG. 3, a normally closed contact 26, which is controlled in dependence on speed, is also present which is connected to the relay contact 41. The coil of the relay 42 is driven, for example, in such a manner that at the instant at which the dynamo of a vehicle supplies an adequate voltage, for example, when the idling speed of the internal combustion engine is reached, the coil is excited. When the internal combustion engine is stopped—or also stalled—the relay 42 drops out again. The switching unit 7, in contrast to that of FIG. 3, only exhibits three switching contacts 19, 20 and 21, the first speed step $n_1$ is reached via the external relay contact 41.

Figure 7:
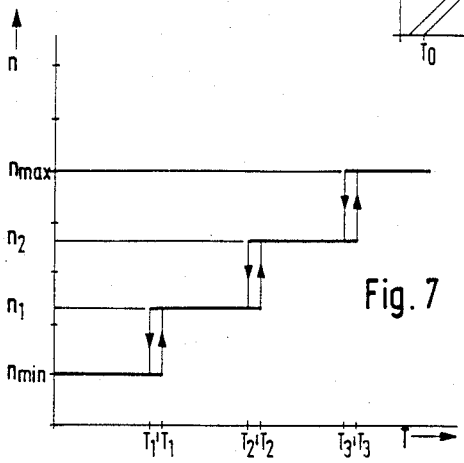
FIG. 7 shows a control characteristic which is achieved by means of a circuit according to FIG. 6.

The control characteristic achieved by means of a control circuit according to FIG. 6 is shown in FIG. 7. So that the full electric power is available for the starter when the internal combustion engine is started, the coil of relay 42 is initially not excited. For this reason, the relay contact 41 is open. Since the switching contacts 19, 20 and 21 of the switching unit 7, for example of a step switch, are also open, no voltage is present at the electric motor 14 so that it stands still. After the starting process of the internal combustion engine, that is to say, after the idling speed has been reached, the dynamo outputs a voltage as a result of which the coil of the relay 42 is excited and the relay contact 41 is closed. The input voltage of the operational amplifier 27 is now changed via the resistor 22 in the previously described manner, so that a minimum speed $n_{min}$ is set up at the electric motor 14. To facilitate the motor start, the switching contact 26 is provided, the function of which has already been described in FIG. 3.

When a first temperature threshold $T_1$ is reached, the switching contact 18 is closed in the manner already described with reference to FIG. 3, as a result of which the gate of the MOSFET 16 is driven by means of a pulse sequence output by the operational amplifier 27. The speed control thus essentially corresponds to the one already described in FIG. 3, but with the difference that a minimum speed $n_{min}$ of the electric motor 14 immediately occurs. Such control characteristic is advantageous particularly for driving water pumps since a minimum flow rate of cooling water through the internal combustion engine must be ensured.

Figure 8:
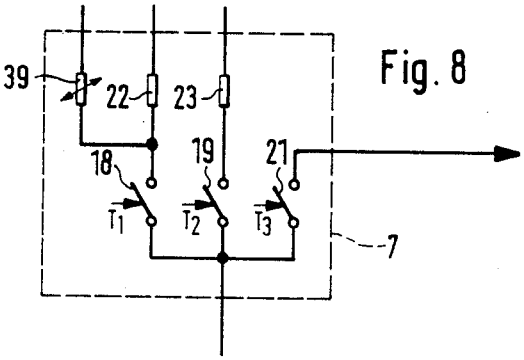
FIG. 8 shows a variant of an embodiment of the temperature-dependent switching contacts according to FIG. 4, including a thermistor.

The difference between FIG. 4 and FIG. 8 consists in the fact that the thermistor 39 is not in parallel with the switching contact 18, but follows it. For the rest, the circuits with respect to the two operational amplifiers 27 and 48 are identical. The resistor 23 should be dimensioned in such a manner that, when the switching contact 19 is closed, the change in resistance at the thermistor 39, as a result of the pulse sequence signal, is insignificant for the drive of the MOSFET 16.

Figure 9:
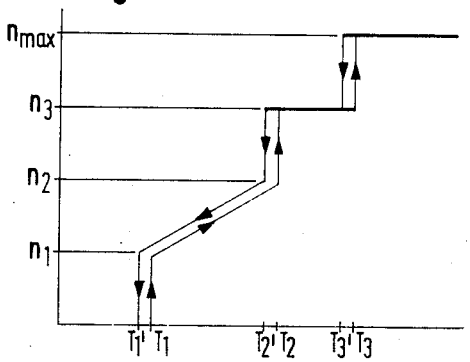
FIG. 9 shows a control characteristic which is achieved by means of the circuit arrangement according to FIG. 8.

The control characteristic achieved by means of a circuit according to FIG. 8 is shown in FIG. 9. It can be seen from this representation that, in contrast to FIG. 5, the section with the steady speed control is not below the first speed step $n_1$ but between speed steps $n_1$ and $n_2$.

In the preceding text, only some illustrative embodiments have been described, for which a number of combinations and suitable variants of the embodiments are conceivable. These could be implemented in a simple manner by means of appropriately adapting the circuit means which are suitable for control devices of this type.

What is claimed is:

1. A cooling system for an internal combustion engine, comprising:

a heat exchanger;

a cooling water pump coupled to said heat exchanger;

a fan disposed adjacent said heat exchanger for conveying cooling air through said heat exchanger;

an electric motor having a variable rotational speed coupled to at least one of said fan and said pump; and a motor control circuit coupled to said motor for controlling said speed, said circuit including, .

a pulse frequency generator having an output signal with a variable pulse-to-pulse ratio and a variable voltage input means for varying said pulse-to-pulse ratio, a power semiconductor device coupled to said electric motor and responsive to said output signal, and sensor means for detecting a temperature condition of said engine, including, at least three switching contacts sequentially actuated when sequentially predetermined temperature thresholds of said temperature condition are sensed by said sensor means, one of said switching contacts corresponding to a highest one of said thresholds being coupled directly to said electric motor and by passing said power semiconductor device and electronic component means coupling remaining ones of said switching contacts to said input means for providing a variable voltage to adjust said pulse-to-pulse ratio of said output signal.

2. Cooling device as claimed in claim 1, wherein said electronic component means are ohmic resistances.

3. Cooling device as claimed in claim 1, wherein said switching contacts are jointly arranged in a step switch.

4. Cooling device as claimed in claim 3, wherein said sensor means further comprises an element of temperature responsive extensible material interacting with said step switch.

5. Cooling device as claimed in claim 4, wherein said step switch is arranged at a radiator tank of said heat exchanger and said element of extensible material projects into said radiator tank so that cooling water flows therearound.

6. Cooling device as claimed in claim 1, wherein said power semiconductor device is an N-channel metal oxide field effect transistor (MOSFET) and said frequency generator is a voltage-controlled frequency generator.

7. Cooling device for an internal combustion engine which comprises:

a heat exchanger, a cooling water pump coupled to the heat exchanger, a fan disposed adjacent to the heat exchanger for conveying cooling air through the heat exchanger, an electric motor coupled to at least one of the fan and the cooling water pump, and a motor circuit connected to the electric motor for controlling the rotational speed of the electric motor, the motor circuit including an operational amplifier, a power semiconductor coupled to the electric motor and responsive to an output signal of the operational amplifier, and a sensor that detects an engine temperature condition, the sensor including at least three switching contacts which are in each case actuated when predetermined temperature thresholds are reached, wherein the switching contact for the highest predetermined temperature threshold is coupled to the electric motor and provides a bypass of the power semiconductor and the remaining switching contacts are coupled via respective electronic components to an input of the operational amplifier, the electronic components influencing an input signal applied to the input of the operational amplifier in accordance with the actuation of the switching contacts to adjust the output signal of the operational amplifier;

wherein the power semiconductor is an N-channel metal oxide field effect transistor (MOSFET) and the operational amplifier is a voltage-controlled frequency generator; and wherein said motor circuit further comprises a switching transistor, the base of which is connected to the output of the frequency generator via two inverting switching stages, is connected between a positive pole of the voltage source and the gate of the metal oxide field effect transistor.

8. Cooling device for an internal combustion engine which comprises:

a heat exchanger, a cooling water pump coupled to the heat exchanger, a fan disposed adjacent to the heat exchanger for conveying cooling air through the heat exchanger, an electric motor coupled to at least one of the fan and the cooling water pump, and a motor circuit connected to the electric motor for controlling the rotational speed of the electric motor, the motor circuit including an operational amplifier, a power semiconductor coupled to the electric motor and responsive to an output signal of the operational amplifier, and a sensor that detects an engine temperature condition, the sensor including at least three switching contacts which are in each case actuated when predetermined temperature thresholds are reached, wherein the switching contact for the highest predetermined temperature threshold is coupled to the electric motor and provides a bypass of the power semiconductor and the remaining switching contacts are coupled via respective electronic components to an input of the operational amplifier, the electronic components influencing an input signal applied to the input of the operational amplifier in accordance with the actuation of the switching contacts to adjust the output signal of the operational amplifier; and a switch connected between the electric power and a rotational speed sensor, wherein the switch opens in response to a predetermined rotational speed of the electric motor.

9. Cooling device for an internal combustion engine which comprises:

a heat exchanger, a cooling water pump coupled to the heat exchanger, a fan disposed adjacent to the heat exchanger for conveying cooling air through the heat exchanger, an electric motor coupled to at least one of the fan and the cooling water pump, and a motor circuit connected to the electric motor for controlling the rotational speed of the electric motor, the motor circuit including an operational amplifier, a power semiconductor coupled to the electric motor and responsive to an output signal of the operational amplifier, and a sensor that detects an engine temperature condition, the sensor including at least three switching contacts which are in each case actuated when predetermined temperature thresholds are reached, wherein the switching contact for the highest predetermined temperature threshold is coupled to the electric motor and provides a bypass of the power semiconductor and the remaining switching contacts are coupled via respective electronic components to an input of the operational amplifier, the electronic components influencing an input signal applied to the input of the operational amplifier in accordance with the actuation of the switching contacts to adjust the output signal of the operational amplifier; and wherein said motor circuit further comprises a relay having a normally open contact provided in a line branch connected in parallel with at least two of the switching contacts, the relay being responsive to at least one of a signal which is dependent on a particular rotational speed of the internal combustion engine and a voltage level of the dynamo of the internal combustion engine.

10. Cooling device for an internal combustion engine which comprises:

a heat exchanger, a cooling water pump coupled to the heat exchanger, a fan disposed adjacent to the heat exchanger for conveying cooling air through the heat exchanger, an electric motor coupled to at least one of the fan and the cooling water pump, and a motor circuit connected to the electric motor for controlling the rotational speed of the electric motor, the motor circuit including an operational amplifier, a power semiconductor coupled to the electric motor and responsive to an output signal of the operational amplifier, and a sensor that detects an engine temperature condition, the sensor including at least three switching contacts which are in each case actuated when predetermined temperature thresholds are reached, wherein the switching contact for the highest predetermined temperature threshold is coupled to the electric motor and provides a bypass of the power semiconductor and the remaining switching contacts are coupled via respective electronic components to an input of the operational amplifier, the electronic components influencing an input signal applied to the input of the operational amplifier in accordance with the actuation of the switching contacts to adjust the output signal of the operational amplifier; and wherein said motor circuit further comprises a thermistor which is connected via a voltage divider to the non-inverting input of a second operational amplifier and the output of the second operational amplifier is connected to the non-inverting input of the first operational amplifier.

11. Cooling device as claimed in claim 10, wherein the thermistor is connected in parallel with the switching contacts.

12. Cooling device as claimed in claim 10, wherein the thermistor is in series with one of the switching contacts.

13. Cooling device as claimed in claim 1, wherein temperature differences between two successive switching thresholds are different, the difference between switching thresholds of higher temperatures being less than between switching thresholds of lower temperatures.

14. Cooling device as claimed in claim 1, wherein temperature differences between two adjacent switching thresholds in each case are equal.

15. A method for controlling a cooling device for an internal combustion engine, said method comprising the steps of:

successively switching contacts of a temperature sensitive sensor of a control circuit for said cooling device when predetermined switching thresholds are reached to change an input parameter to a non-inverting input of an operational amplifier provided in said control circuit;

driving a power semiconductor device included in said control circuit with an output of said operational amplifier in such a manner that an electric motor connected to said semiconductor device coupled to at least one of a fan and cooling water pump is operated at certain rotational speeds allocated in steps to respective switching thresholds, and bypassing said power semiconductor device to drive said electric motor when a last switching contact closes by connecting said electric motor directly to said last switching contact.

16. Method as claimed in claim 15, wherein said rotational speed of said electric motor is controlled proportionally in dependence on the cooling water temperature until a first temperature threshold is reached.

17. Method as claimed in claim 15, wherein said rotational speed of said electric motor is controlled proportionally in dependence on cooling water temperature after a first temperature threshold has been exceeded and until a second temperature threshold is reached.

18. A method for controlling a cooling device for an internal combustion engine, said method comprising the steps of:

successively switching contacts of a temperature sensitive sensor of a control circuit for said cooling device when predetermined switching thresholds are reached to change an input parameter to a non-inverting input of an operational amplifier provided in said control circuit;

driving a power semiconductor device included in said control circuit with an output of said operational amplifier in such a manner that an electric motor connected to said semiconductor device coupled to at least one of a fan and cooling water pump is operated at certain rotational speeds allocated in steps to respective ones of said switching thresholds, and bypassing said power semiconductor device to drive said electric motor when a last switching contact closes by connecting said electric motor directly to said last switching contact; and generating a signal for exciting a relay when an idling speed of said internal combustion engine is reached, closing a contact of said relay to influence an input signal to said operational amplifier in such a manner that said power semiconductor device is driven with a pulse sequence which corresponds to a relative turn-on period of said power semiconductor device, during which said electric motor is driven at a minimum speed.

* * * * *